United States Patent [19]

Rees

[11] 4,418,652

[45] Dec. 6, 1983

[54] STEAM GENERATOR HAVING A SUPERHEATER TUBE BANK

[75] Inventor: Karl Rees, Ruti, Switzerland

[73] Assignee: Sulzer Brothers Limited, Winterthur, Switzerland

[21] Appl. No.: 408,926

[22] Filed: Aug. 17, 1982

[30] Foreign Application Priority Data

Sep. 15, 1981 [CH] Switzerland ..... 5943/81

[51] Int. Cl.[3] ..... F22G 3/00

[52] U.S. Cl. ..... 122/468; 122/235 A; 122/235 K; 122/511

[58] Field of Search ..... 122/460, 468, 469, 471, 122/235 A, 235 K, 20 A, 20 B, 511

[56] References Cited

U.S. PATENT DOCUMENTS 3,263,422 8/1966 Gorzegno ..... 122/468
4,178,881 12/1979 Pratt ..... 122/235 A
4,244,327 1/1981 Ssinegurski ..... 122/468 X
4,245,588 1/1981 Gill et al. ..... 122/235 K

*Primary Examiner*—Edward G. Favors
*Attorney, Agent, or Firm*—Kenyon & Kenyon

[57] ABSTRACT

The steam generator has a combustion chamber which merges at the top into a combustion gas flue having walls in the form of evaporator tubes. A superheater tube bank is suspended in the combustion gas flue in front of the evaporator tubes. The superheater tubes are connected together in pairs to a common inlet at a lower end which passes through the evaporator tube banks while the evaporator tubes of the combustion chamber are connected in pairs to a single evaporator tube within the flue.

Retaining elements are provided to form a moving connection between the superheater tubes and the evaporator tube and provision is made to compensate for differences in expansion between the superheater tubes and the evaporator tubes at the top end of the superheater tube bank.

13 Claims, 11 Drawing Figures

STEAM GENERATOR HAVING A SUPERHEATER TUBE BANK

This invention relates to a steam generator. More particularly, this invention relates to a steam generator having a superheater tube bank for preventing overheating of an evaporator tube bank in a combustion gas flue.

Heretofore, it has been known to construct steam generators such that a combustion chamber merges at an upper end into a combustion gas flue having walls which take the form of evaporator tube banks. In order to prevent overheating of the evaporator tube banks, it has also been known to suspend a bank of superheater tubes in the flue in front of the evaporator tube bank. In this case, the tubes of the superheater bank form fallers and risers while the entry and exit portions of the superheater tubes extend through the evaporator tube bank near the top end of the superheater tube bank. However, one disadvantage of this arrangement is that the superheater tube banks cannot be dewatered for the start-up of the steam generator. Consequently, individual tubes may fail to be cooled adequately at starting.

Accordingly, it is an object of the invention to provide a superheater tube bank for protecting an evaporator tube bank in a steam generator which can be readily dewatered.

It is another object of the invention to provide a simple construction for mounting a superheater tube bank within a combustion gas flue of a steam generator to protect an evaporator tube bank therein.

It is another object of the invention to avoid excessive thermal stressing of the mounting arrangement for a superheater tube bank within a combustion gas flue of a steam generator.

Briefly, the invention is directed to a steam generator having a combustion chamber with at least two walls which define evaporator tubes and a gas flue above and in communication with the combustion chamber. In addition, the flue has at least two walls each of which includes a plurality of evaporator tubes and webs which secure the tubes together in seal-tight manner and a bank of vertical superheater tubes is disposed in the gas flue over the evaporator tubes.

In accordance with the invention, each evaporator tube of the gas flue is connected at a lower end to a pair of evaporator tubes of the combustion chamber. Also, each pair of adjacent superheater tubes is connected in common at a lower end to a bend which extends through a respective web of the gas flue walls.

The simple construction of the bottom end of the superheater tube bank permits a working medium to be delivered to the superheater tubes and obviates excessive thermal stressing. As such, the connection of the superheater tube bank at the entry end is very advantageous.

Retaining means are also provided which connect the bank of superheater tubes to the walls of the gas flue in relatively movable manner. In this way, differential movements between the superheater bank and the evaporator tubes can be accommodated. For example, the retaining means may include a plurality of hooks which are secured to the superheater tube bank at an intermediate height and which are slidably received in slots in the webs of the walls of the gas flue. This provides a simple construction to prevent the superheater tubes from bending out of the plane of the superheater tube bank.

Means are also provided at the top part of the bank of superheater tubes for compensating for differences in expansion between the superheater tubes and the evaporator tubes. In one embodiment, each of the superheater tubes extends at an upper end through a respective web of an evaporator wall with a sliding seal provided between each upper end of the superheater tube and the evaporator wall. This serves to obviate additional kinking stresses which may act on the tubes of the superheater bank. Further, each sliding seal may include a longitudinal aperture in a web of the gas flue wall and a pair of spaced cover strips which are secured to a respective superheater tube passing through the gas flue wall to opposite sides of the aperture. Each of the cover strips is sized to cover the aperture so that the superheater tubes may expand freely.

Each superheater tube may also be provided with fins in order to partially shield the evaporator tubes. In this way, for the same shielding effect, the number of superheater tubes and the weight of the pressurized components can be reduced.

In order to reduce the number of exit points, the superheater tubes can be forked together in pairs at the top edge of the superheater tube bank before extending through the evaporator tube bank. Alternatively, in order to obviate additional thermal stresses due to different discharges through adjacent superheater tubes, the tubes may extend through the flue gas walls in alternating horizontal planes.

In order to obviate flue gas leakage losses, the exit points of the superheater tubes near the top edge of the superheater tube bank can be provided with bellows-type seals on the outside of the evaporator tube bank.

In another embodiment, the superheater tubes may be provided with inclined upper ends which form expansion arms and with bends which extend through the flue gas wall. These expansion arms permit sliding seals to be eliminated.

These and other objects and advantages of the invention will become more apparent from the following detailed description taken in conjunction with the accompanying drawings wherein.

Figure 1:
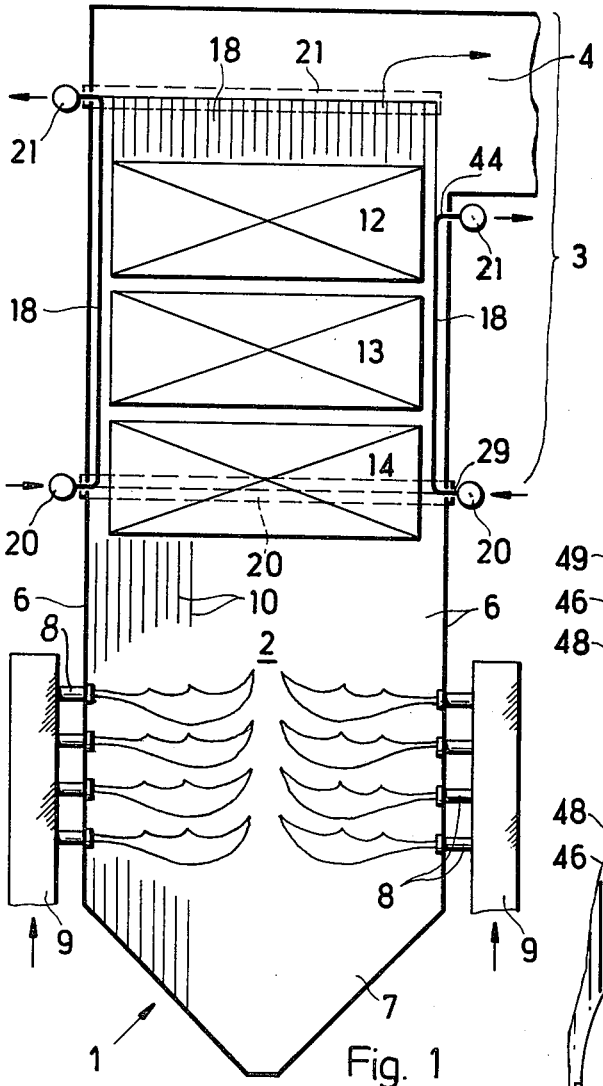
FIG. 1 illustrates a diagrammatic vertical sectional view through a steam generator constructed in accordance with the invention.

Referring to FIG. 1, a steam generator 1 is constructed with a combustion chamber 2 which merges at the top into a combustion gas flue 3 and a cross-flue 4 which extends from the top of the combustion gas flue 3 in a horizontal manner. As indicated, the combustion chamber 2 and the gas flue 3 are bounded by four vertical walls 6 while the bottom of the combustion chamber 2 is provided with a funnel 7 formed by walls or banks of tubes. In addition, four burners 8 are disposed near the vertical edges between every two adjacent walls 6 and are supplied with air via ducts 9 and fuel via other lines (not shown). The vertical walls 6 of the combustion chamber 2 and the walls of the funnel 7 consist of tubes 10 which are welded together in gas-tight manner to serve as evaporator heating surfaces. A plurality of contact heating surfaces 12, 13, 14 are suspended in the flue 3 in known manner. The heating surface 14 can take the form of a number of panel-like vertical platen heating surfaces (not shown).

In order to prevent overheating of the evaporator tube bank portions which extend along the flue 3, a plurality of superheater tube banks 18 are disposed on the flue gas side of the evaporator tube banks. The four superheater tube banks 18 are in the form of a narrow grid of vertical tubes which are connected at the bottom to distributors 20 outside the flue 3 and at the top to headers 21 which are disposed outside the flue 3.

Figure 2:
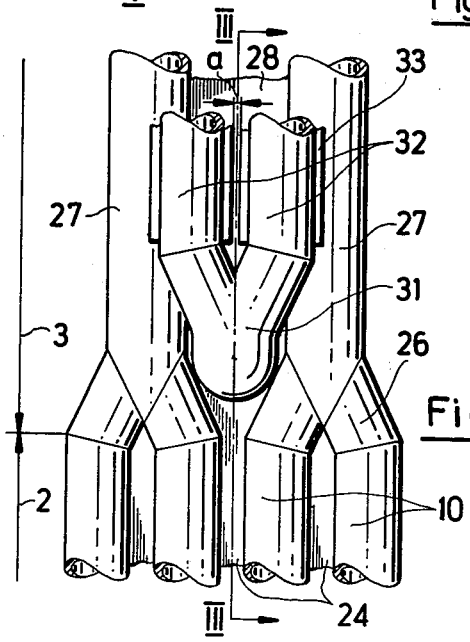
FIG. 2 illustrates a fragmentary view of a bottom part of a superheater tube bank constructed in accordance with the invention.
Figure 3:
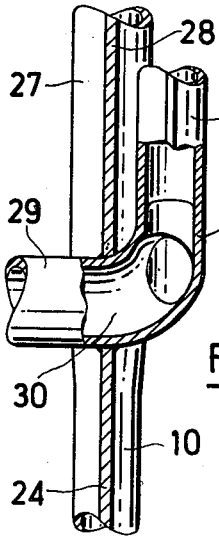
FIG. 3 illustrates a view taken on line III—III of FIG. 2.

Referring to FIGS. 2 and 3, the walls of the combustion chamber 2 are formed of the evaporator tubes 10 and webs 24 which are secured, as by welding, to the tubes 10 in seal-tight manner. Likewise, the walls of the gas flue 3 are formed by a plurality of evaporator tubes 27 and webs 28 which secure the tubes 27 together in seal-tight manner. Further, each evaporator tube 27 is connected in common at a lower end of the flue 3 to a pair of adjacent evaporator tubes 10 via a forked connector 26. The wide webs 28 extend between the adjacent tubes 27 so that the tubes 10, 27 with the webs 24, 28, respectively, form seal-tight diaphragm walls.

As indicated in FIGS. 2 and 3, each superheater tube bank includes a plurality of vertical tubes 32. Further, each pair of adjacent tubes 32 is connected in common as by welding at a lower end via a forked element 31 which has a bend 30 extending through a web 28 of the flue gas wall to a distributor (not shown). As indicated in FIG. 3, each bend 30 extends through a bottom gusset of a web 28.

Each pair of vertical tubes 32 carries fins 33 on opposite sides in order to shield the evaporator tubes 27. As indicated in FIG. 2, the fins 33 of adjacent tubes 32 are spaced apart by a distance a. This insures that only a very reduced heat radiation may occur on the evaporator tube walls beind the superheater banks 18.

Figure 4:
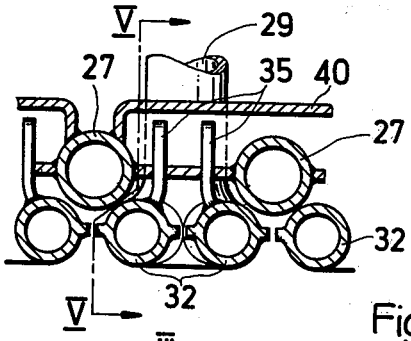
FIG. 4 illustrates a view taken on IV—IV of FIG. 5.
Figure 5:
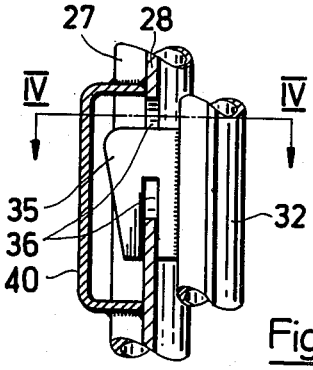
FIG. 5 illustrates a view taken on V—V of FIG. 4.

Referring to FIGS. 4 and 5, retaining means are provided intermediately of the height of the superheater tube banks 18 in order to connect the superheater tube banks 18 to the gas flue walls in relatively movable relation. As shown, the retaining means includes a plurality of hooks 35 each of which is welded to the back of a superheater tube 32 and which is slidably received in a slot 36 in a web 28 of the gas flue wall. As shown in FIG. 5, each hook 35 passes through a slot 36 and hooks over a part of the web 28 of the gas flue wall. In order to provide for seal tightness, the slots 36 and hooks 35 are covered by boxes 40 which are welded in seal-tight manner to the outside of the evaporator tube bank 6.

Figure 6:
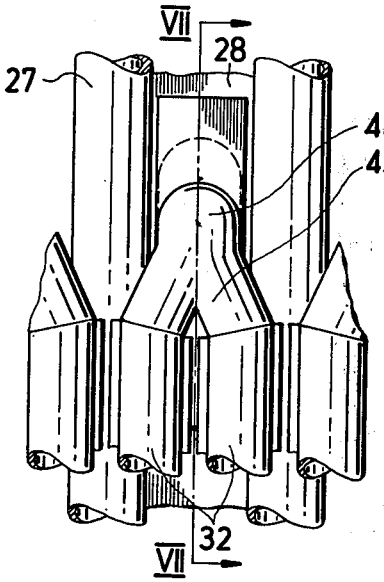
FIG. 6 illustrates a fragmentary view of an upper end of a superheater tube bank constructed in accordance with the invention.
Figure 7:
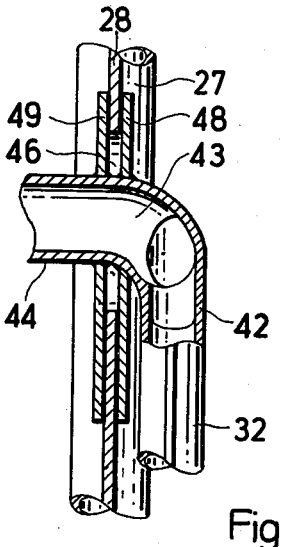
FIG. 7 illustrates a view taken on line VII—VII of FIG. 6.

Referring to FIGS. 6 and 7, the upper ends of each pair of adjacent superheater tubes 32 are welded in common to a forked element 42 which has a bend 43 which passes through a web 28 of the flue gas wall to a header (not shown). As indicated in FIG. 7, each tube bend 43 has a horizontal arm 44 which extends away from an elongated aperture 46 in a web 28.

Means are also provided at a top part of the superheater tube bank for compensating for differences in expansion between the superheater tubes 32 and the evaporator tubes 27. To this end, a sliding seal is formed between the superheater tubes and the evaporator wall. This sliding seal is composed of a pair of spaced cover strips 48, 49 which are secured, as by welding, to the horizontal arm 44 of a tube bend 43 to opposite sides of the aperture 46 and the web 28. Each of these cover strips 48, 49 is sized to cover the aperture 46 so that the arm 44 can move within the aperture 46 in response to differences in heat expansion between the superheater tubes 32 and evaporator tubes 27 while the strips continue to cover the aperture 46.

Of note, the cover strips 48, 49 may not provide complete seal tightness. Hence, the arm 44 may be connected to the outside of the evaporator tube bank by way of a bellows (not shown) which permits vertical movements. This will provide for complete sealing.

During operation, a working medium can be delivered via the distributors 20 (see FIG. 1) to the superheater tubes 32 via the forked elements 31. After passing upwardly through the superheater tubes 32, the working medium can be delivered via the forked elements 42 to the headers 21 (see FIG. 1).

It is to be noted that in the event of an unequal distribution of the working medium flow between the two finned tubes 32 which are interconnected by a forked element 31, the flows in each tube 32 may be heated differently. This may result in heat stresses in view of the fixed connection of the superheater tubes 32 between the forked elements 31, 42.

Figure 8:
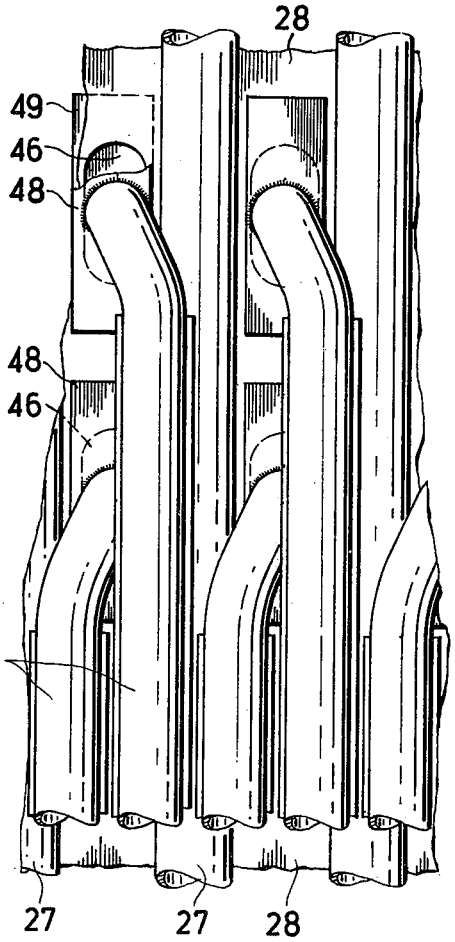
FIG. 8 illustrates a view of a modified upper end of a superheater tube bank constructed in accordance with the invention.

In order to avoid kinking stresses which may act on the superheater tubes 32, the tubes 32 of a tube pair may extend separately through the evaporator tube bank via apertures 46 which are disposed one below another in alternating horizontal planes (see FIG. 8). As above, the apertures 46 may be covered over by cover strips 48, 49 secured to a horizontal part of a bend of each tube 32 which passes through an aperture 46 in a web 28 of the flue gas wall.

Figure 9:
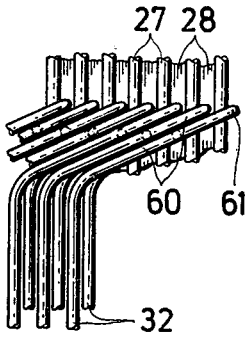
FIG. 9 illustrates a modified upper end of a superheater tube bank in accordance with the invention.
Figure 10:
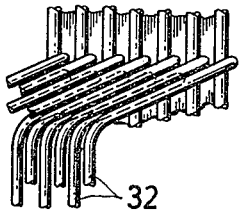
FIG. 10 illustrates a further modified upper end of a superheater tube bank in accordance with the invention.

Referring to FIG. 9, in order to eliminate the need for sliding seals, each superheater tube 32 may be formed with an inclined upper end to form an expansion arm 60 with a bend 61 which extends through an aperture in a web 28 of the evaporator tube bank. In this case, the adjacent expansion arms 60 of each pair of tubes 32 can either extend in the same inclined plane which is perpendicular to the evaporator tube bank as shown in FIG. 9 or may be offset from one another as shown in FIG. 10. The offset or stagger enables the cranking of the inner expansion arms 60 to be reduced.

Figure 11:
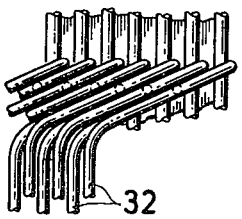
FIG. 11 illustrates a still further modified upper end of a superheater tube bank in accordance with the invention.

Referring to FIG. 11, the superheater tubes 32 may be provided with inclined expansion arms such that the second of the two arms forming a pair can be bent inwardly.

Of note, it is desirable and, in the light of the thermal stressing of the diaphragm wall, completely permissible for the superheater tubes 32 to be unfinned near the expansion arms 60.

The invention thus provides a relatively simple construction of a superheater tube bank for protecting an evaporator tube bank within a combustion gas flue of a steam generator. Further, the superheater tube bank is constructed so that the superheater tubes can be easily dewatered for start-up of the steam generator.

What is claimed is:

1. In a steam generator, the combination comprising a combustion chamber having at least two walls of evaporator tubes;

a gas flue above and in communication with said combustion chamber, said flue having at least two walls, each said wall including a plurality of evaporator tubes and webs securing said tubes together in seal-tight manner;

a plurality of forked connectors at a lower end of said flue, each connector connecting a respective pair of adjacent evaporator tubes of said combustion chamber walls to a respective evaporator tube of said gas flue walls;

a bank of vertical superheater tubes disposed in said gas flue over said evaporator tubes; and a plurality of forked elements at a lower end of said bank of said superheater tubes, each said forked element having a bend extending through a respective web between an adjacent pair of said evaporator tubes of said gas flue walls and being connected respectively to a pair of said superheater tubes to distribute a working medium therebetween.

2. The combination as set forth in claim 1 which further comprises retaining means connecting said bank of superheater tubes to said walls of said gas flue in relatively movable manner.

3. The combination as set forth in claim 2 wherein said retaining means include a plurality of hooks, each said hook being secured to said bank of superheater tubes and slidably received in a slot in a respective web of a wall of said gas flue.

4. The combination as set forth in claim 1 which further comprises means at a top part of said bank of superheater tubes for compensating for differences in expansion between said superheater tubes and said evaporator tubes.

5. The combination as set forth in claim 1 wherein each superheater tube at an upper end thereof extends through a respective web of an evaporator wall and which further comprises a sliding seal between each upper end of a respective superheater tube and said evaporator wall.

6. The combination as set forth in claim 5 wherein each sliding seal includes a longitudinal aperture in a web of said gas flue wall and a pair of spaced cover strips secured to a respective superheater tube passing through said gas flue wall to opposite sides of said aperture, each said cover strip being sized to cover said aperture.

7. The combination as set forth in claim 1 wherein each superheater tube has fins thereon to partially shield said evaporator tubes of said gas flue walls.

8. The combination as set forth in claim 1 which further comprises a plurality of forked elements at an upper end of said flue, each said latter forked element having a bend extending through a respective web between an adjacent pair of said evaporator tubes of said gas flue walls and being connected respectively to a pair of said superheater tubes to receive working medium therefrom.

9. The combination as set forth in claim 1 wherein said superheater tubes at upper ends thereof extend through a respective flue gas wall in alternating horizontal planes.

10. The combination as set forth in claim 1 wherein said superheater tubes at upper ends thereof extend through a respective flue gas wall and which further comprises a plurality of bellows-type seals, each said seal being disposed between an upper end of a respective superheater tube and an exterior of a respective flue gas wall to seal said superheater tube relative to said flue gas wall.

11. The combination as set forth in claim 1 wherein each said superheater tube has an inclined upper end to form an expansion arm with a bend extending through a respective flue gas wall.

12. In a steam generator, the combination comprising a combustion chamber having at least two walls of evaporator tubes;

a gas flue above and in communication with said combustion chamber, said flue having at least two walls, each said wall including a plurality of evaporator tubes and webs securing said tubes together in seal-tight manner, each evaporator tube of said gas flue being connected in common at a lower end to a respective adjacent pair of said evaporator tubes of said combustion chamber;

a bank of vertical superheater tubes disposed in said gas flue over said evaporator tubes, each pair of adjacent superheater tubes being connected in common at a lower end to a bend extending through a respective web of said gas flue walls.

13. The combination as set forth in claim 12 which further comprises retaining means connecting said bank of superheater tubes to said walls of said gas flue in relatively movable manner and means at a top part of said bank of superheater tubes for compensating for differences in expansion between said superheater tubes and said evaporator tubes.

* * * * *